US008727651B2

(12) United States Patent
Arai et al.

(10) Patent No.: US 8,727,651 B2
(45) Date of Patent: May 20, 2014

(54) TWISTABLE CONTAINER FOR ELEVATING A SOLID STICK

(75) Inventors: Ken Arai, Osaka (JP); Takamitsu Okawara, Osaka (JP); Masakazu Mameta, Osaka (JP); Tsutomu Kobayashi, Osaka (JP); Hideo Uemura, Osaka (JP)

(73) Assignees: Rohto Pharmaceutical Co., Ltd., Osaka (JP); Yoshino Kogyosho Co., Ltd, Tokyo (JP)

( * ) Notice: Subject to any disclaimer, the term of this patent is extended or adjusted under 35 U.S.C. 154(b) by 334 days.

(21) Appl. No.: 12/866,143

(22) PCT Filed: Feb. 3, 2009

(86) PCT No.: PCT/JP2009/051800
§ 371 (c)(1),
(2), (4) Date: Aug. 4, 2010

(87) PCT Pub. No.: WO2009/099069
PCT Pub. Date: Aug. 13, 2009

(65) Prior Publication Data

US 2011/0033220 A1 Feb. 10, 2011

(30) Foreign Application Priority Data

Feb. 4, 2008 (JP) ..... 2008-024262
May 30, 2008 (JP) ..... 2008-142596

(51) Int. Cl.
*B43K 5/06* (2006.01)

(52) U.S. Cl.
USPC ..... 401/175; 401/68; 401/87; 401/171

(58) Field of Classification Search
CPC . A45D 40/04; A45D 40/06; A45D 2040/208; A45D 40/12; B65D 83/0011
USPC ..... 401/75, 87, 175, 68, 78, 80, 171, 172
See application file for complete search history.

(56) References Cited

U.S. PATENT DOCUMENTS 4,369,158 A * 1/1983 Woodruff et al. ..... 401/175
4,521,127 A * 6/1985 Tomburo et al. ..... 401/68

(Continued)

FOREIGN PATENT DOCUMENTS

JP U-55-131982 9/1980
JP U-04-071676 6/1992

(Continued)

OTHER PUBLICATIONS

International Preliminary Report on Patentability in International Application No. PCT/JP2009/051800; dated Sep. 7, 2010.

(Continued)

*Primary Examiner* — David Walczak
*Assistant Examiner* — Bradley Oliver
(74) *Attorney, Agent, or Firm* — Oliff PLC

(57) ABSTRACT

An elevating container includes an elliptically shaped main tube, a non-circularly shaped moveable support unit which moves upwardly or downwardly along an inner surface of a storage tube of the main tube without rotating, and a driving unit fitted to the main tube to rotate in threaded engagement to the support unit without moving upwardly or downwardly. A seal section at the lower end of the inner peripheral surface of the storage tube and a sealing cylinder at the lower end of the support unit are air-tightly fitted to each other. In addition, positioning ribs are provided at the lower end of the storage tube, and positioning notches are provided at the lower end of the moveable support unit. When the positioning ribs and the positioning notches are engaged with each other, a circumferential misalignment between the main tube and the support unit is corrected.

7 Claims, 7 Drawing Sheets

(56) References Cited

U.S. PATENT DOCUMENTS

| | | | | |
|---|---|---|---|---|
| 4,664,547 | A * | 5/1987 | Rosenwinkel | 401/175 |
| 4,915,528 | A * | 4/1990 | Seager | 401/68 |
| 5,217,145 | A | 6/1993 | Haan et al. | |
| 5,255,990 | A | 10/1993 | Dornbusch et al. | |
| 5,753,212 | A * | 5/1998 | Pescatore et al. | 424/65 |
| 5,839,622 | A | 11/1998 | Bicknell et al. | |
| 5,961,007 | A * | 10/1999 | Dornbusch et al. | 401/175 |
| 5,967,683 | A * | 10/1999 | Fattori | 401/68 |
| 7,207,739 | B1 * | 4/2007 | Preteroti | 401/175 |
| 8,079,499 | B2 * | 12/2011 | Juteau et al. | 401/175 |
| 2006/0013640 | A1 * | 1/2006 | Skakoon et al. | 401/175 |
| 2006/0193676 | A1 * | 8/2006 | Gordon | 401/55 |
| 2006/0204314 | A1 * | 9/2006 | Murakoshi | 401/87 |
| 2008/0050168 | A1 * | 2/2008 | Groh et al. | 401/68 |
| 2010/0104345 | A1 * | 4/2010 | Nasu et al. | 401/68 |
| 2013/0193167 | A1 * | 8/2013 | Arora et al. | 401/68 |

FOREIGN PATENT DOCUMENTS

| | | |
|---|---|---|
| JP | A-07-507754 | 8/1995 |
| JP | A-11-514535 | 12/1999 |
| JP | A-2000-238863 | 9/2000 |
| JP | A-2002-086990 | 3/2002 |

OTHER PUBLICATIONS

International Search Report in International Application No. PCT/JP2009/051800; dated May 19, 2009 (with English-language translation).

* cited by examiner (a)

(b)

TWISTABLE CONTAINER FOR ELEVATING A SOLID STICK

TECHNICAL FIELD

This invention relates to a twistable container for elevating a solid stick so as to draw out of a tube, a little bit at a time, and put back therein, the solid stick including cosmetics, such as lipstick and lip cream; a solid glue stick; and a solid liniment stick.

BACKGROUND ART

Twistable containers for elevating solid sticks are known. These containers comprise a main tube in a straight cylindrical shape, a central shaft standing upright on a central axis of this main tube, a driving unit fitted at a lower end of the main tube in a manner rotatable but unable to go up and down, and a movable support unit which is in a screw engagement with the central shaft of the driving unit and is fitted to the main tube in a manner unable to rotate relative to the main tube but capable of tightly and slidably going up and down along the central shaft. The container is filled with a solid material to be stored in a space formed by the main tube, the movable support unit, and the central shaft. This solid material is drawn out of the main tube a little bit at a time and is put back in the tube, by rotating the driving unit.

Such an ordinary twistable container has the main tube and the movable support unit in the shapes of perfectly circular cylinders. Locking mechanisms are usually provided between the main tube and the movable support unit so that the movable support unit would not rotate relative to the main tube. However, the locking mechanism on the main tube often forms an irregular pattern on the surface of the solid material. Thus, users may not have been quite satisfied with the products because this irregular surface looks unfavorable.

A conventional technical means of eliminating this dissatisfaction was that the main tube and the movable support unit have a cross-sectional shape, which includes a non-circular shape, such as a polygonal shape, and a roughly circular shape, such as an oval shape, but excludes a perfect circular shape, so that the locking mechanisms would not be required. With such a cross-section, the material would not have any irregular surface, and thus, would be able to retain favorable appearance. Patent Document 1 is known to show examples of such a cross-sectional shape.

[Patent Document 1] JP2000-238863

In the case of this conventional technology, there occurs no rotational displacement between the main tube and the movable support unit, when engaged with each other, even if the locking mechanisms for exclusive use are not provided, because the main tube and the movable support unit have a cross-sectional shape which is not a circle or a perfect circle. This would lead the stick material to have a smooth outer peripheral surface just like the smooth inner peripheral wall of the main tube.

DISCLOSURE OF THE INVENTION

Problems to be Solved by the Invention

However, the above conventional technology has a problem due to the fact that the movable support unit is engaged with the main tube in a manner capable of going up or down. Clearance inevitably arises when the movable support unit is fitted into the main tube. Because of this clearance, there occurs slight "misalignment" along a rotating direction between the main tube and the movable support unit.

This misalignment has no adverse effect on the ascending or descending movement of the movable support unit inside the main tube, but has a large adverse effect on a sealing property achieved between the main tube and the movable support unit. Especially when the movable support unit is located at the limit of descent, that is, when the stick material is stored inside the main tube, there arises a problem in that with a decrease in the sealing property, the material loses much of its ability to retain the quality of product.

As described above, even if there occurs slight misalignment between the main tube and the movable support unit, it has no adverse effect on the elevating movement of the movable support unit. However, since the movable support unit clings to the main tube at the lower limit position under a misaligned condition, the movable support unit firstly has to be released from this clinging situation. Thus, there is a problem of decreased workability.

This invention has been made to solve the technical problems found in the above conventional technology. Regarding the twistable container comprising a main tube and a movable support unit having a cross-sectional shape which is not a circle or a perfect circle, a technical problem of this invention is to position the movable support unit at the limit of descent without causing any peripheral "misalignment" to occur relative to the main tube. Objects of this invention are to secure the sealing ability of the twistable container under the condition that the material has been stored inside the main tube and to smooth the movement of the movable support unit at the onset of use.

Means of Solving the Problems

The twistable container of this invention for elevating a solid stick mainly comprises:

a main tube having a seal portion at a lower end of an inner peripheral wall of a straight cylindrical storage tube in a cross-sectional shape which is not a circle or a perfect circle, a driving unit fitted to a lower end of this main tube in a manner unable to go up or down but able to rotate, said driving unit having a central shaft disposed upright at the center of the main tube, and a movable support unit fitted in the storage tube in a manner unable to rotate but able to go up or down slidably, the movable support unit having a screw engagement with a screw-threaded portion notched on the central shaft standing upright along a central axis and having also a sealing cylinder disposed at a lower end so as to have tight contact with the seal portion of the storage tube, wherein a storage space, in which to store the solid stick, is formed by the storage tube, the movable support unit, and the central shaft, and wherein this solid stick is drawn out of the main tube a little bit at a time and is put back therein.

The main tube has a cross-sectional shape which is not a circle or a perfect circle, and stores cosmetics, such as lipstick and lip cream, and other solid materials, such as solid glue stick and solid liniment stick. The main tube is provided with positioning ribs at the lower end of the storage tube and with the sealing portion disposed at the lower end on the inner surface of the main tube.

The driving unit is fitted to the lower end of the main tube, and the driving unit is in an exposed state at its lower end. By rotating this exposed portion with fingers, the user can twist the driving unit relative to the main tube and the movable support unit.

The movable support unit is provided with positioning notches in a lower end portion of the sealing cylinder disposed at the lower end of this unit. These positioning notches are engaged with the positioning ribs of the main tube. In this way, circumferential "misalignment" of the movable support unit is forcibly corrected relative to the main tube.

The positioning ribs on the main tube are disposed at the lower end of the storage tube where a portion at the lower end of the storage tube is used as the seal portion. The positioning notches are disposed in the lower end portion of the sealing cylinder, for which the lower end of the movable support unit has been set aside. In a state in which the positioning ribs are engaged with the positioning notches, the movable support unit is at the limit of descent, and the seal portion is in tight contact with the sealing cylinder, thus creating a sealed state between the main tube and the movable support unit.

When the driving unit is twisted relative to the main tube in this state, the driving unit rotates also relative to the movable support unit, and in turn, the movable support unit goes upward so that the stick material emerges from the upper opening of the main tube.

In a state where the movable support unit is positioned at the limit of descent and where the stick material is in the stored state, the engagement of the positioning ribs with the positioning notches ensures that the movable support unit is fitted to the main tube in a state having no misalignment in the circumferential direction. Thus, the seal portion of the main tube is in tight contact with the sealing cylinder of the movable support unit without any misalignment.

At the onset of movement, the movable support unit would start climbing in a right posture with no misalignment and no rattling movemtn, because the engagement of the positioning ribs with the positioning notches holds the support unit forcibly at the position causing no circumferential misalignment relative to the main tube when the support unit is positioned at the limit of descent in the stored state.

In addition to the main feature described above, another feature of this invention is that the movable support unit comprises an outer straight cylinder having a cross-sectional shape which is not a circle or a perfect circle and having sliding contact with the storage tube, and an inner straight cylinder coaxially disposed with, and connected to, the outer cylinder by way of a bottom plate wherein the screw-threaded portion of the central shaft runs through the center of the inner cylinder vertically and has a screw engagement with the inner cylinder.

The movable support unit comprising the outer cylinder, the inner cylinder, and the bottom plate can be used as a contents-holding portion, by placing the lower end of the material on the bottom plate spaced between the outer cylinder and the inner cylinder having a functional portion to be engaged with the screw-threaded portion of the central shaft.

In addition to the main feature described above, another feature of this invention is that the positioning ribs in a triangular ridge segment shape are disposed at the lower end of the seal portion of the main tube while the positioning notches in an inverted V shape are formed at the lower end of the sealing cylinder of the movable support unit.

In the case of the positioning ribs and notches formed in a triangular shape, oblique sides of the triangle would serve as guiding sides, and the "misalignment," if any, would be forcibly corrected by these oblique sides, which lead the descending movement of the movable support unit so as to put the unit in place.

In addition to the main feature described above, another feature of this invention is that a pair of the positioning rib/notch combinations is disposed axisymmetrically on both ends of a virtual major axis of the cross-sectional shape which is not a circle or a perfect circle If a pair of the positioning rib/notch combinations is disposed axisymmetrically on both ends of the major axis of the cross-sectional shape, these rib/notch combinations can be disposed at positions remotest to each other. At such axisymmetrical positions, this force of correcting the misalignment can be applied most strongly and axisymmetrically. That is, the correcting force can be applied reliably and properly.

In addition to the main feature described above, another feature of this invention is that a bore diameter of the seal portion is set at a level slightly smaller than a bore diameter of the other inner peripheral wall portion of the storage tube and that an outer diameter of the sealing cylinder is set at a level slightly smaller than an outer diameter of the other outer peripheral wall portion of the movable support unit.

If the seal portion has a bore diameter slightly smaller than that of the other inner wall portion of the storage tube, and if the sealing cylinder has an outer diameter slightly smaller than that of the other outer wall portion of the movable support unit, then the sealing cylinder does not come into tight sliding contact with the portion of the storage tube other than the seal portion, and thus, no large slide resistance would be generated between the sealing cylinder and the portion of the storage tube other than the seal portion.

In addition to the main feature described above, another feature of this invention is that the movable support unit has an outer diameter slightly smaller than the bore diameter of the storage tube and that a slidably-contacting peripheral rib is integrally formed at an upper end of the outer peripheral wall of the movable support unit so that this peripheral rib would come into sliding contact with the inner peripheral wall of the storage tube.

If the movable support unit has an outer diameter slightly smaller than the bore diameter of the storage tube, no large force of slide resistance is generated between the main tube and the movable support unit. The slidably-contacting peripheral rib is in sliding contact with the inner peripheral wall of the storage tube over all the range of upward/downward movement of the movable support unit.

Another feature of this invention is that multiple, flexibly-contacting projecting ribs having a low projecting height are disposed at a peripheral edge of the slidably-contacting peripheral rib so that force of flexible contact with the inner peripheral wall of the storage tube of the main tube would have roughly uniform distribution of force along the circumference of the slidably-contacting peripheral rib.

If the multiple, flexibly-contacting projecting ribs are disposed on the peripheral edge of the slidably-contacting peripheral rib, a rattling movement of the movable support unit in contact with the main tube is prevented from occurring because multiple, flexibly-contacting projecting ribs come into flexible contact with the inner peripheral wall of the storage tube. The force of slide resistance may be generated between the movable support unit and the main tube, but this force can be reduced since the flexible contact of the movable support unit with the storage tube can be achieved from points of contact by the multiple, flexibly-contacting projecting ribs.

Another feature of this invention is that a total of four flexibly-contacting projecting ribs are disposed on the slidably-contacting peripheral rib having a cross-sectional shape of an elliptical ring, at both ends of those peripheral rib segments having a large radius of curvature.

If the slidably-contacting peripheral rib in an elliptical ring shape has a total of four flexibly-contacting projecting ribs at the positions described above, it turns out that these projecting ribs are located nearby both ends of each of the rib segments going side-by-side with a major axis of the slidably-contacting peripheral rib. These rib segments are where the clinging situation tends to occur between the movable support unit and the storage tube. However, because of the flexible contact of the projecting ribs with the inner peripheral wall of the storage tube, the rib segments going side-by-side with the major axis of the movable support unit, with flexibly-contacting projecting ribs on both sides, would never be pushed strongly, and get stuck, to the inner peripheral wall of the storage tube.

Effects of the Invention

This invention having the above-described constructive features has the following effects:

The twistable container of this invention for elevating a solid stick ensures that any "misalignment" of the movable support unit relative to the main tube is forcibly corrected in the circumferential direction by the engagements of the positioning ribs with the positioning notches. Thus, it becomes possible to bring the sealing cylinder of the movable support unit into tight contact with the seal portion of the main tube and thereby to obtain a reliable and stable seal between the movable support unit and the main tube in the state in which the solid stick is inside the storage tube.

The movable support unit in its storage state is properly positioned relative to the main tube, owing to the engagement of the positioning ribs with the positioning notches, and always starts going up from a right position, thus enabling favorable movement to be secured.

The movable support unit comprising the outer cylinder, the inner cylinder, and the bottom plate can hold the material firmly and steadily.

Since the positioning ribs and notches are formed in a triangular shape, any misalignment that has taken place is corrected forcibly by the descending movement of the movable support unit, and therefore, ordinary tube handling is enough to correct the misalignment.

Ordinary tube handling ensures any misalignment to be corrected reliably and properly by disposing two pairs of the positioning ribs and notches axisymmetrically on both ends of the major axis because at these positions, the force of correcting the misalignment can be applied strongly and axisymmetrically, too.

The seal portion has a bore diameter slightly smaller than that of the other inner wall portion of the storage tube, and the sealing cylinder has an outer diameter slightly smaller than that of the other outer wall portion of the movable support unit. Since no large slide resistance would be generated between the sealing cylinder and the movable support unit, smooth tube handling can be achieved to draw the stick from inside.

In the case of the movable support unit having a slidably-contacting peripheral rib, the rib is in sliding contact with the inner peripheral wall of the storage tube along an entire length of upward/downward movement of the movable support unit. Because of this sliding contact, a rattling movement of the movable support unit in contact with the main tube is prevented from occurring in all the length of upward/downward movement. The slidably-contacting peripheral rib in contact with the storage tube allows slide resistance to be generated only mildly, and smooth handling of the tube is obtained.

If the movable support unit has multiple flexibly-contacting projecting ribs disposed on the edge of the slidably-contacting peripheral rib, the rattling movement of the movable support unit is prevented from occurring in contact with the main tube. Since the force of slide resistance generated between the movable support contact and the main tube can be decreased, the rattling movement can be easily prevented, and in addition, favorable handling can be obtained. Especially, because each flexibly-contacting projecting rib is small in size, the mold for molding the movable support unit is easily modified or micro-adjusted.

As described above, the slidably-contacting peripheral rib in an elliptical ring shape is provided with a total of four flexibly-contacting projecting ribs at both ends of those peripheral rib segments having a large radius of curvature. In that case, each of the rib segments going side-by-side with the major axis would never be pushed strongly toward the inner peripheral wall of the storage tube. Therefore, the clinging situation can be effectively prevented from occurring between the movable support unit and the storage tube. As a result, the container can be used safely.

DESCRIPTION OF REFERENCE SIGNS

Figure 1:
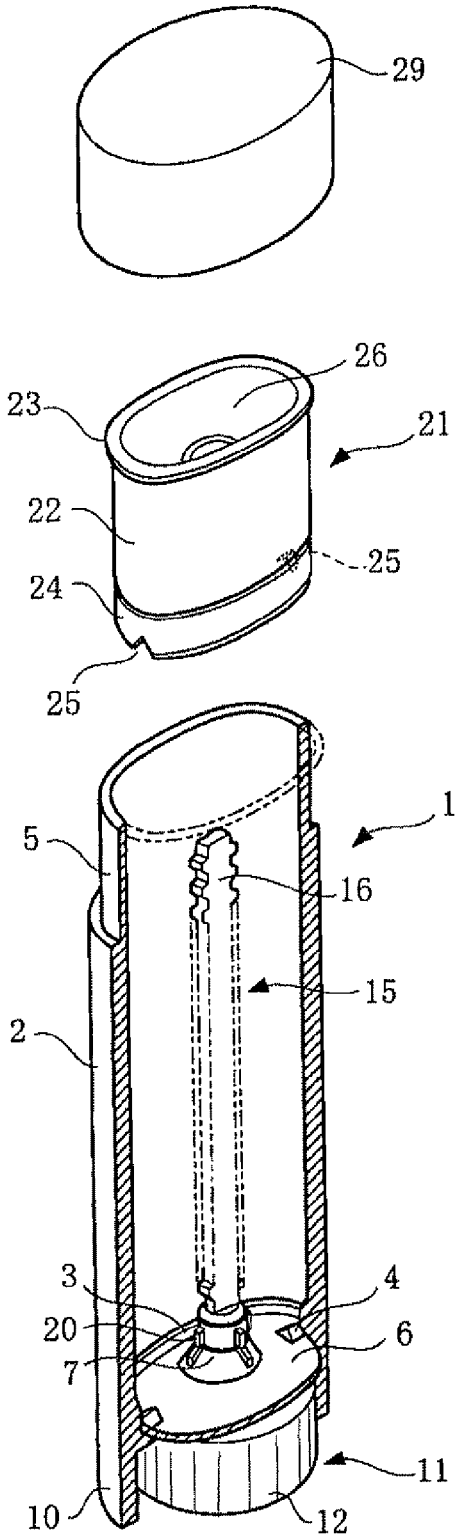
FIG. 1 is an exploded perspective view, partly in a vertical section, of the twistable container for elevating a solid stick in one embodiment of this invention.

1. Main tube
2. Storage tube
3. Seal portion
4. Positioning rib
5. Cap-fitting section
6. Inner brim plate
7. Locking brim
8. Downward circular ridge
9. Inner peripheral step portion
10. Foot
11. Driving unit
12. Turn knob
13. Rotary top plate
14. Outer peripheral step portion
15. Central shaft
16. Screw-threaded portion
17. Shaft seal
18. Shaft base
19. Peripheral locking overhang
20. Stop ridge segment
21. Movable support unit
22. Outer cylinder
23. Slidably-contacting peripheral rib
23*a*. Flexibly-contacting projecting rib
24. Sealing cylinder
25. Positioning notch
26. Inner cylinder
27. Inner peripheral seal surface
28. Stopping piece

29. Bottom plate
30. Cap
M. Material
a: Misalignment

A PREFERRED EMBODIMENT OF THE INVENTION

This invention is further described with respect to a preferred embodiment, now referring to the drawings.

The twistable container for elevating a solid stick, as shown diagrammatically in the preferred embodiment of this invention, comprises a main tube 1 in the shape of an elliptical cylinder having a cross-sectional shape which is not a circle or a perfect circle, a driving unit 11 having a central shaft 15 basically in a straight round bar shape, a movable support unit 21 in the shape of a double-wall cylinder connected by a bottom plate, and a cap 30 for opening or closing a top opening of the main tube.

The main tube 1 is a main body for storing a solid material M including cosmetics, such as lipstick or lip cream, a solid glue stick, or a solid liniment stick. The main tube 1 comprises a storage tube 2 in the shape of a straight, elliptical cylinder, a seal portion 3 formed by narrowing slightly a lower end portion of an inner peripheral wall of the storage tube 2, an inward brim plate 6 in a ring shape disposed at the lower end of the storage tube 2 where the seal portion 3 is formed, positioning ribs 4 in a triangular ridge segment shape projecting from the inner brim plate 6, and a pair of feet 10 extending from the storage tube 2 downward at both major-axis ends.

The storage tube 2 gradually narrows at the lower end of the inner peripheral wall to form the seal portion 3. A cap-fitting section 5 at an upper end of the outer peripheral wall of the storage tube 2 is where a cap 30 is fitted around. The cap-fitting section 5 is formed by narrowing the outer diameter in one step from the outer surface of the main tube 1.

A pair of the positioning ribs 4 is disposed on a virtual major axis of the main tube 1 having a cross-sectional shape of an ellipse and at axisymmetrical positions on the central axis.

The inner brim plate 6 is connected to an innermost locking brim 7 which has a skirt-like shape and extends obliquely upward from the inner brim plate 6. A downward circular ridge 8 is formed so as to project from the inner brim plate 6 and is brought in sliding contact with a rotary top plate 13 of the driving unit 11. An inner peripheral step portion 9 is formed outside of this downward circular ridge 8 so that the stepped portion 9 forms an inner peripheral wall. The innermost locking brim 7, a little shorter than the inner brim plate 6, is provided with cut-out slits shaped corresponding to stop ridge segments 20 of the driving unit 11 so that the locking ridge segments 20 are fitted to the driving unit 11 with no trouble.

The driving unit 11 comprises a cylindrical turn knob 12 having a knurled outer peripheral surface, an upright rod-like central shaft 15 disposed at the center of the rotary top plate 13 of the turn knob 12, a screw-threaded portion 16 having male left-hand screw threads notched on the most part of the central shaft 15, except for a lower end portion thereof, a shaft seal 17 disposed immediately under the screw thread 16 to accomplish a seal between the movable support unit 21 and the driving unit 11, and a shaft base 18 disposed under this shaft seal 17 and engaged with the locking brim 7.

A peripheral locking overhang 19 is disposed in a top end portion of the shaft base 18 which is slidably in contact with a forefront of the locking brim 7. Four stop ridge segments 20 are disposed immediately above this overhang 19 in an overlapping manner and radially at an equal central angle.

An outer peripheral step portion 14 forms an outward peripheral surface along an outermost side of the rotary top plate 13 of the turn knob 12. This stepped portion 14 is fitted in a rotatable manner to the inner peripheral step portion 9 of the main tube 1 so as to steady the rotatable engagement of the driving unit 11 with the main tube 1.

The screw-threaded portion 16 is of a structure in which both sides of the shaft is cut off along the entire threaded portion so that the central shaft 15 would not have tight contact with the material M (See FIG. 1). Under this structure, air channels are formed along the cutoff side portions when the screw-threaded portion 16 is rotated relative to the material M.

The turn knob 12 is positioned between both feet. The locking brim 7 of the main tube 1 is fitted around the shaft base 18 of the driving unit 11 under a condition that the inner peripheral step portion 9 of the inner brim plate 6 sits on the outer peripheral step portion 14 of the rotary top plate 13. As shown in Table 3, the driving unit 11 is fitted to the main tube 1 in a manner able to rotate but unable to break away, by keeping the forefront of the locking brim 7 attached to an underside corner of the peripheral locking overhang 19. At that time, the downward circular ridge 8 of the inner brim plate 6 comes in contact with the top surface of the rotary top plate 13 of the driving unit 11, and this contact secures the smooth engagement of the locking brim 7 with the downside of the peripheral locking overhang 19.

The movable support unit 21 has a double-wall structure in which the double walls are connected by a bottom. More specifically, the movable support unit 21 comprises an outer cylinder 22 in the shape of a short, elliptical cylinder, which is slidably fitted into the storage tube 2 and which is provided with a slidably-contacting peripheral rib 23 at the top edge of the outer peripheral wall so that the peripheral rib 23 is slidably contacted with the inner peripheral wall of the storage tube 2, an inner cylinder 26 in the shape of a short, circular cylinder, which is fitted around the central shaft 15 and is brought in a screw engagement with the screw-threaded portion 16, and a bottom plate 29 disposed between the lower end of the inner cylinder 26 and the lower end of the outer cylinder 22.

Figure 6:
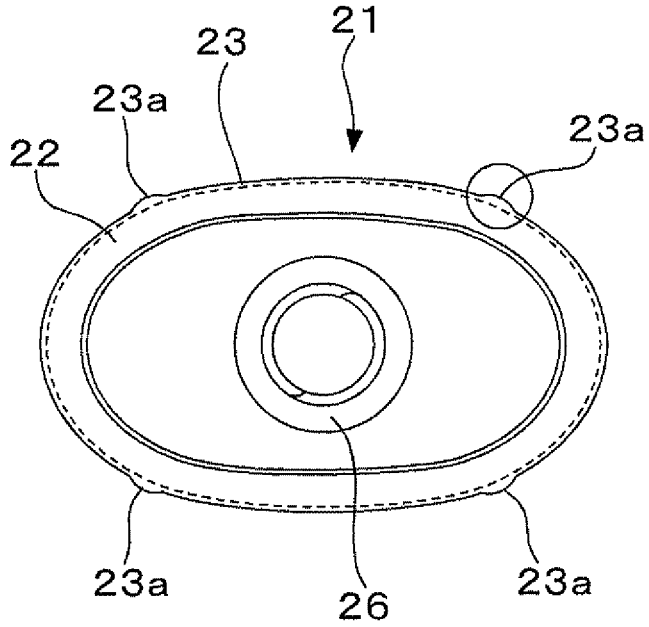
FIG. 6 is a plan view of the entire movable support unit in the embodiment shown in FIG. 1.
Figure 7:
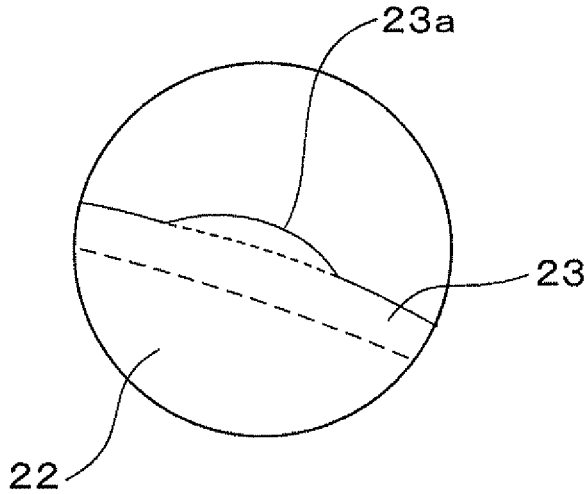
FIGS. 7(*a*) and 7(*b*) are an enlarged view and an enlarged vertical section of an important part of the movable support unit shown in FIG. 6.
Figure 7:
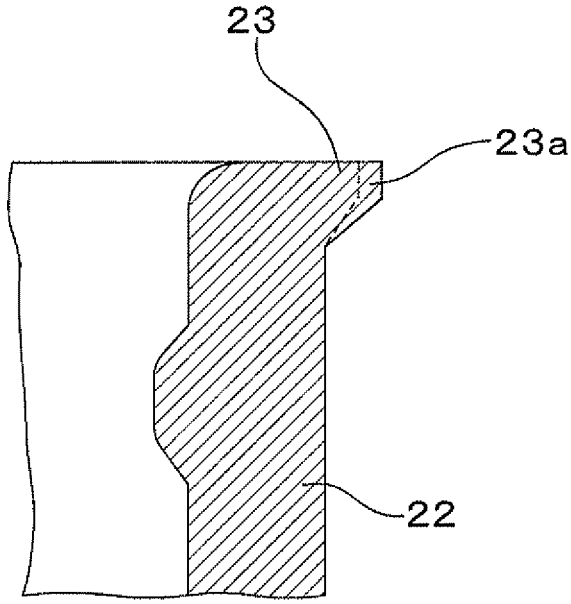

The slidably-contacting peripheral rib 23 in the shape of an elliptical ring has a total of four flexibly-contacting projecting ribs 23*a* on both ends of those peripheral rib segments having a large radius of curvature (See FIGS. 6 and 7). The rattling engagement of the movable support unit 21 with the storage tube 2 is prevented by allowing these flexibly-contacting projecting ribs 23*a* to come in flexible contact with the inner peripheral wall of the storage tube 2.

Both ends of each of those ridge segments going side-by-side with a major axis of the slidably-connecting peripheral rib 23 are where the clinging situation tends to occur when each ridge segment is pushed toward the inner peripheral wall of the storage tube 2 by the swings occurring in the circumferential direction at the time of an ascending/descending movement. However, because of the flexible contact of the projecting ribs 23*a* with the inner peripheral wall of the storage tube 2, each ridge segment would never get stuck to the storage tube 2. Therefore, the clinging situation is prevented from occurring.

The lowest portion of the outer cylinder 22 below the bottom plate 29 has an outer diameter slightly narrower than in the other outer-wall portion of the outer cylinder 22, and forms a sealing cylinder 24 to be tightly fitted in the seal portion 3 of the main tube 1. A pair of positioning notches 25 in an inverted V shape is disposed axisymmetrically at the lower end, and on the virtual major axis, of the sealing cylinder 24 (See FIG. 4) so that these positioning notches 25 are engaged with the positioning ribs 4 of the main tube 1. A shaft seal 17 of the driving unit 11 is in tight contact with an inner peripheral seal surface 27, which is a smooth, inner peripheral wall disposed below the bottom plate 29 in the lowest portion of the inner cylinder 26. Four stopping pieces 28 are disposed under the lower end of the inner cylinder 26 at equal central angle positions. These stop pieces 28 bump into and stop the rotating stop ridge segments 20.

Figure 2:
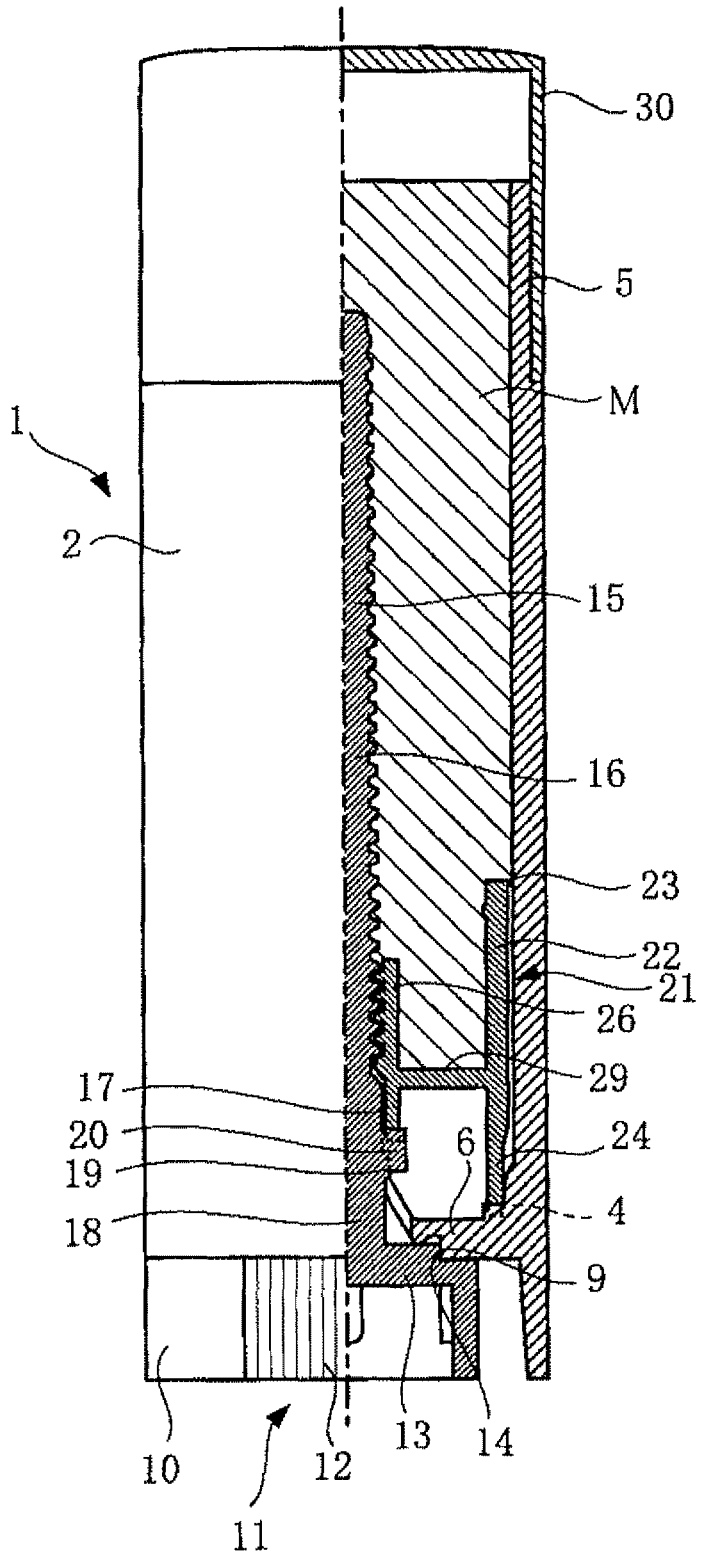
FIG. 2 is a front view of the embodiment shown in FIG. 1, with the right half in a vertical section.
Figure 3:
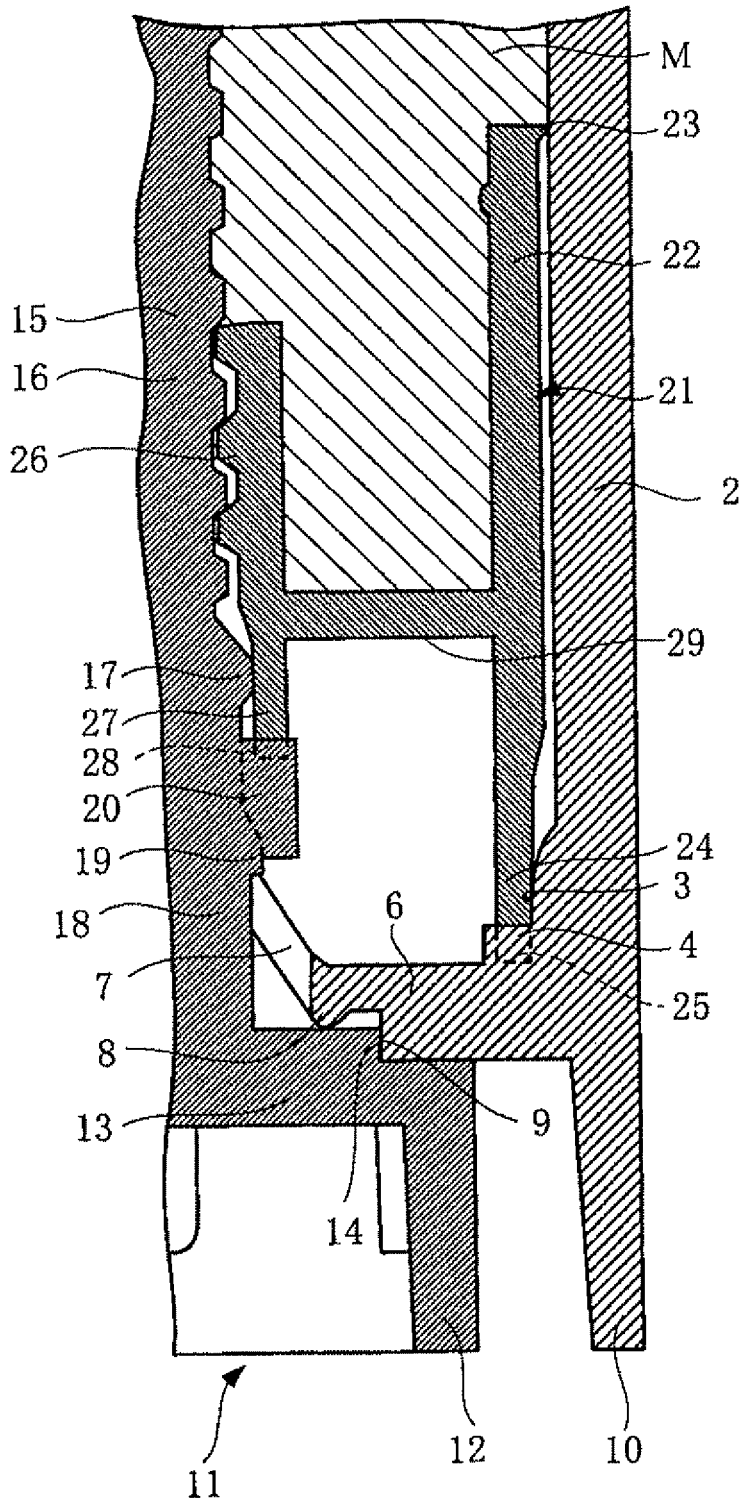
FIG. 3 is an enlarged vertical section of an important part of the embodiment shown in FIG. 2.
Figure 4:
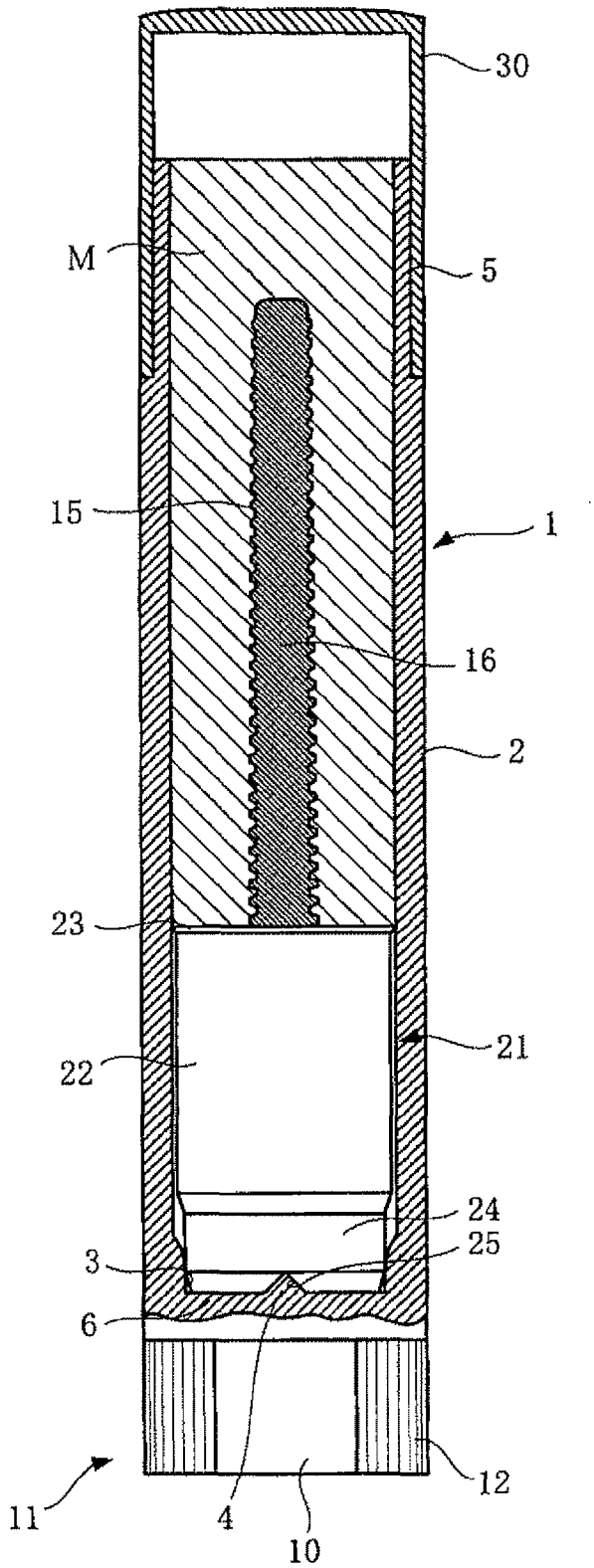
FIG. 4 is a side vertical section of the embodiment shown in FIG. 1.
Figure 5:
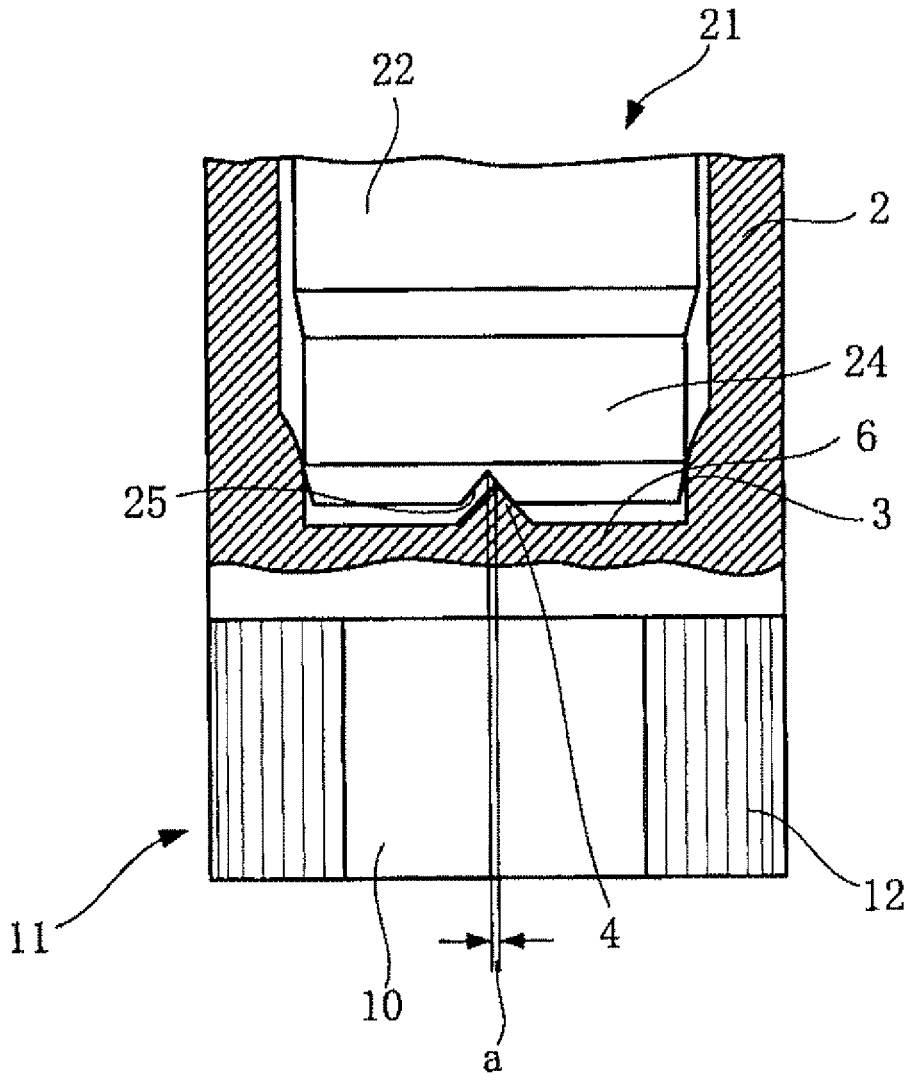
FIG. 5 is a partially enlarged explanatory diagram used to explain the misalignment-correcting movement.

The positioning ribs 4 of the main tube 1 are engaged with the positioning notches 25 of the movable support unit 21 in the state in which the movable support unit 21 is at the limit of descent (See FIGS. 2 and 4). Under this condition, even if any misalignment [a] occurs between, e.g., the main tube 1 and the movable support unit 21 in the circumferential direction, as shown in FIG. 5, this misalignment [a] is forcibly corrected because the seal portion 3 of the main tube 1 would come in tight contact with the sealing cylinder 24 of the movable support unit 21 uniformly along the entire circumference to obtain a steady and reliable seal.

Since under this condition, the stopping pieces 28 bump into the stop ridge segments 20, the movable support unit 21 is kept at the position where the support unit 21 has reached the limit of descent.

This invention is further described with respect to the assembly and mechanism of the main tube 1, the driving unit 11, and the movable support unit 21.

The inner peripheral step portion 9 of the main tube 1 is put on the outer peripheral step portion 14 of the driving unit 11 for an interlocking engagement. At that time, the downward circular ridge 8 comes in contact with the top surface of the rotary top plate 13. Furthermore, the locking brim 7 is fitted around the shaft base 18, and is locked by the peripheral locking overhang 19 when the forefront of the locking brim 7 is interlocked around the underside corner of the overhang. In this state, the driving unit 11 is fitted to the main tube 1 in a manner able to rotate but unable to go up or down.

The movable support unit 21 is fitted inside the storage tube 2 of the main tube 1 in a manner unable to rotate but able to go up or down, and is fitted to the driving unit 11 in a manner enabling the driving unit 21 to rotate but not to go up or down. This can be down by bringing the inner cylinder 26 into a screw engagement with the screw-threaded portion 16, and also by fitting the outer cylinder 22 in an elliptical cylinder shape into the storage tube 2 in a similar shape of the elliptical cylinder.

The limit of descent for the movable support unit 21 is determined by a bump of the lower end of the sealing cylinder 24 of the outer cylinder 22 onto the top surface of the inner brim plate 6.

The twistable container is filled with a material M as follows: First, the main tube 1, the driving unit 11, and the movable support unit 21 are assembled. As shown in FIG. 2, the movable support unit 21 is positioned at the limit of descent. The material, such as lipstick, in a molten state is poured in the storage tube 2, and then cooled and solidified.

INDUSTRIAL APPLICABILITY

As obvious from the foregoing description, the twistable container of this invention for elevating a solid stick secures a high sealing property because a "misalignment" in the circumferential direction is forcibly corrected between the storage tube and the movable support unit, both having a cross-sectional shape which is not a circle or a perfect circle. A cross-sectional shape which is not a circle or a perfect circle prevents the storage tube and the movable support unit from clinging to each other although such a clinging situation tends to occur in the case of tubes having a circular cross-section. Because the high sealing property and the lack of the clinging situation are required for the twistable containers for elevating solid sticks, the twistable container of this invention can be expected to have wide applications of use.

The invention claimed is:

1. A twistable container for elevating a solid stick comprising:

a main tube including:

a straight cylindrical storage tube having a non-circular horizontal cross-sectional shape, a cap-fitting section disposed at an upper end of an outer peripheral wall of the storage tube, a pair of feet extending downwardly from the storage tube, a seal portion formed at a lower end of an inner peripheral wall of the storage tube, a central shaft disposed longitudinally along a central axis of the main tube;

a driving unit fitted to a lower end of the main tube that is unable to move up or down the main tube but is able to rotate in the main tube, said driving unit having the central shaft disposed upright in the center of the main tube;

a non-rotatable movable support unit fitted in the storage tube that is slidably movable up or down the storage tube, the movable support unit having a screw engagement with a screw-threaded portion notched on the central shaft, and also having a sealing cylinder disposed at a lower end so as to tightly contact the seal portion of the storage tube; and a storage space for storing the solid stick, the storage space being formed of: (1) the storage tube, (2) the movable support unit, and (3) the central shaft, wherein axially projecting upward positioning ribs formed in a triangular ridge segment shape and disposed on a radially extensive inward brim plate at the lower end of the storage tube are brought to an engagement with axially confronting downward positioning notches formed in an inverted V shape and disposed in a lower end portion of the movable support unit so as to forcibly correct any circumferential misalignment of the movable support unit relative to the main tube.

2. The twistable container for elevating a solid stick, according to claim 1, wherein the movable support unit includes:

an outer straight cylinder having a cross-sectional shape which is not a circle or a perfect circle, said outer cylinder being in sliding contact with the storage tube, and an inner straight cylinder coaxially disposed with, and connected to, the outer cylinder by way of a bottom plate and wherein the screw-threaded portion of the central shaft runs through the center of the inner cylinder vertically to have a screw engagement with the inner cylinder.

3. The twistable container for elevating a solid stick, according to claim 1, wherein a pair of the axially projecting upward positioning rib and axially confronting downward notch combinations are disposed axisymmetrically on both ends of a virtual major axis of a cross-sectional shape which is not a circle or a perfect circle of the storage tube and the moveable support unit.

4. The twistable container for elevating a solid stick according to claim 1, wherein a bore diameter of the seal portion is set at a level slightly smaller than any bore diameter of other inner peripheral wall portions of the storage tube and wherein an outer diameter of the sealing cylinder is set at a level slightly smaller than any outer diameter of other outer peripheral wall portions of the movable support unit.

5. The twistable container for elevating a solid stick according to claim 1, wherein the movable support unit has an outer diameter slightly smaller than the bore diameter of the storage tube and wherein a slidably-contacting peripheral rib is integrally formed at an upper end of the outer peripheral wall of the movable support unit so that this peripheral rib would come into sliding contact with the inner peripheral wall of the storage tube.

6. The twistable container for elevating a solid stick, according to claim 5, wherein multiple flexibly-contacting projecting ribs having a low projecting height are disposed at a peripheral edge of the slidably-contacting peripheral rib so that force of flexible contact with the inner peripheral wall of the storage tube of the main tube would have roughly uniform distribution of force along the circumference of the slidably-contacting peripheral rib.

7. The twistable container for elevating a solid stick according to claim 6, wherein a total of four flexibly-contacting projecting ribs are disposed on the slidably-contacting peripheral rib having a cross-sectional shape of an elliptical ring, at both ends of peripheral rib segments having a large radius of curvature.

* * * * *

UNITED STATES PATENT AND TRADEMARK OFFICE

CERTIFICATE OF CORRECTION

PATENT NO. : 8,727,651 B2
APPLICATION NO. : 12/866143
DATED : May 20, 2014
INVENTOR(S) : Ken Arai et al.

It is certified that error appears in the above-identified patent and that said Letters Patent is hereby corrected as shown below:

In the Specification:

In column 3, line 32, please delete “movemtn” and insert --movement--, therefore.

In column 4, line 2, please delete “circle” and insert --circle.--, therefore.

Signed and Sealed this
Twenty-eighth Day of October, 2014

Michelle K. Lee

Michelle K. Lee
*Deputy Director of the United States Patent and Trademark Office*